United States Patent [19]

Eaton et al.

[11] Patent Number: 5,040,902

[45] Date of Patent: Aug. 20, 1991

[54] TRASH BAG CLOSURE SYSTEM

[75] Inventors: Bradley W. Eaton, St. Paul; Keith E. Moe, Woodbury; Roland R. Midgley, Minneapolis, all of Minn.

[73] Assignee: Minnesota Mining and Manufacturing Company, St. Paul, Minn.

[21] Appl. No.: 560,430

[22] Filed: Jul. 31, 1990

[51] Int. Cl.[5] ..... B65D 33/38; B65D 33/30

[52] U.S. Cl. ..... 383/7; 383/43; 383/71; 383/120

[58] Field of Search ..... 383/33, 43, 71, 120; 220/404

[56] References Cited

U.S. PATENT DOCUMENTS

| | | | |
|---|---|---|---|
| 2,585,214 | 2/1952 | Belmont | 426/106 X |
| 2,631,629 | 3/1953 | Lee | 383/43 X |
| 4,314,558 | 2/1982 | Korpman | 383/43 X |
| 4,509,570 | 4/1985 | Eby et al. | 383/33 X |
| 4,558,801 | 12/1985 | Vilutis | 220/404 |
| 4,747,701 | 5/1988 | Perkins | 383/33 |
| 4,908,247 | 3/1990 | Baird et al. | 383/71 X |
| 4,913,560 | 4/1990 | Herrington | 383/71 |
| 4,953,704 | 9/1990 | Cortese | 383/43 X |

*Primary Examiner*—Stephen Marcus
*Assistant Examiner*—Jes F. Pascua
*Attorney, Agent, or Firm*—Gary L. Griswold; Roger R. Tamte; William J. Bond

[57] ABSTRACT

A gussetted plastic bag and liner, wherein the bag is maintained open by an attached elastic band. The elastic is placed on either side of at least one gusset fold(s) in an untensioned state, so as to bridge the gusset. When the bag top is folded over a container rim, the elastic is stretched on the outside of the container. This placement permits the bag to be folded flat while providing a means to keep the bag open during use. The elastic is useful as a closure after use.

16 Claims, 1 Drawing Sheet

TRASH BAG CLOSURE SYSTEM

FIELD OF THE INVENTION

The present invention relates to bags and, more particularly, trash bags with supplemental means to keep the bag open in use and closures therefore.

BACKGROUND OF THE INVENTION

Plastic trash bags are produced and sold on an extensive scale in a variety of shapes and sizes. The vast majority of these bags are made of polyethylene film. The bags are generally quite simple, having an open end with straight sidewalls, often joined by a seam(s), with a closed bottom. The trash bags also serve as trash can liners. Conventionally, the upper edge of the bag is rolled over the upper lip of the trash container. A problem, however, is how to keep the bag open and attached to the top of the container. Some trash cans are described as having means to secure the trash bag to the container, such as U.S. Pat. No. 4,738,478 (Bean), who describes a retaining ring with an elastic band that fits within a U-shaped track in the rigid ring. The bag is retained on the trash can by the elastic band. Of course, this is only a limited solution. It has also been proposed to place an elastic band on the trash bag itself in U.S. Pat. No. 4,509,570. The elastic band is located in a hem at the top of the trash bag along its full circumference in a stretched condition. However, this construction has disadvantages in terms of cost, manufacturing and packaging. A major problem with the construction is that the bag top will gather (see FIG. 3), whereas most bags are required to fold into a flat sheet for efficient manufacturing and packaging, which is virtually impossible with a gathered bag. U.S. Pat. No. 4,747,701 (Perkins) proposes a solution to the gathering problem. Perkins places a wide elastic band at the rim of the bag which has the same circumference as the main plastic side portions of the bag. The wide elastic band (2 to 5 inches wide) is then turned over onto the rim of the trash container. This allegedly causes a slight elongation of the elastic band which will allegedly retain the bag on the rim. This is an expensive solution, as significant amounts of elastic are used. Additionally, unless the trash container rim circumference is closely matched to that of the trash bag, this method is likely ineffective. Too large a trash container will create excessive shear stresses in the elastic increasing the likelihood of detachment from the main bag. A trash container rim with a circumference about the same as or smaller than the trash bag circumference is unlikely to create enough elastic retraction force to retain the bag.

Another area of concern is how to close the bag following use. Conventional closures include twist ties (metal wires) or plastic closures such as discussed in U.S. Pat. No. 4,477,950 (Cisek, et al.). It has also been proposed to attach closure elements to the bags themselves, e.g., U.S. Pat. No. 3,974,960 (Mitchell) (a plastic tie strip), and U.S. Pat. Nos. 4,913,560, 4,906,108 and 4,813,794 (all to Herrington or Herrington, et al.), that describe tacky plastic closures. The use of draw strings or tape is also popular as discussed in U.S. Pat. Nos. 4,762,430 (Ballard), 4,813,792 (Belmont, et al.) and 4,813,793 (Belmont, et al.). However, these closures do not address the problems of how to keep the bag open and attached to the trash container.

The present invention is directed at solving some of the problems with the prior art by providing a simple means that will serve to keep a bag open in use while also serving as a closure, which is advantageous in terms of cost, packaging and manufacture.

BRIEF SUMMARY OF THE INVENTION

The invention is directed to a gussetted plastic bag and liner, wherein the bag is maintained open by an attached elastic band. The elastic is placed on either side of at least one gusset fold(s) in an untensioned state, so as to bridge the gusset. The elastic is at a position near the top of the bag such that when the leading edge is folded over the container rim, the elastic is on the outside of the container. This elastic can be placed over more than one gusset. This placement permits the bag to be folded flat while providing a means to keep the bag open during use and useful as a closure after use.

In a further aspect of the invention, the material employed is a non-tacky inelastic laminate material which when placed over the container is stretched and becomes elastic.

DESCRIPTION OF THE PREFERRED EMBODIMENTS

Figure 1:
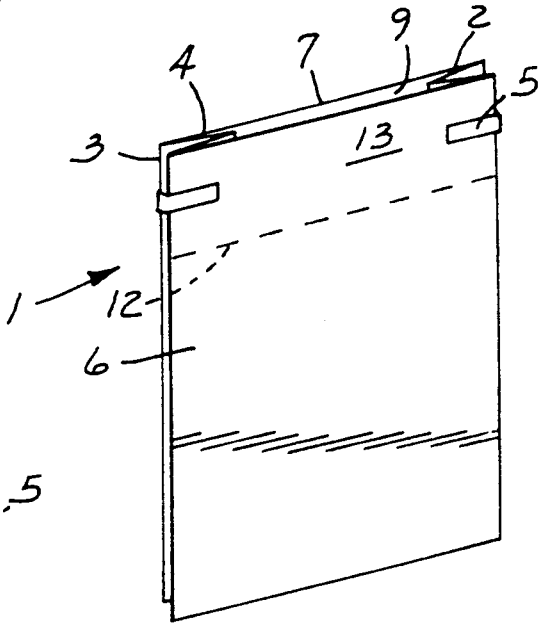
FIG. 1 is a plastic bag having attached elastic according to the invention.

FIG. 1 illustrates an embodiment of the invention gussetted bag 1. The gussetted bag 1 has two opposing gussets or folds 2. This bag 1 will include a front 6 and rear 7 panel. The sides of the bag 1 have been longitudinally folded into gussets 2, which as shown are on opposing side edges of the bag 1. Each of the gussets 2 have leading edge folds 3 defining the longitudinal edges of the front 6 and rear 7 panels with the gussets separating the panels. Interposed between the leading edge folds is at least one inner fold region 4. The bag material forming the inner fold region 4 is interposed between front and rear panels 6 and 7. The bottom of the bag 1 is sealed, generally by heat sealing.

Figure 3:
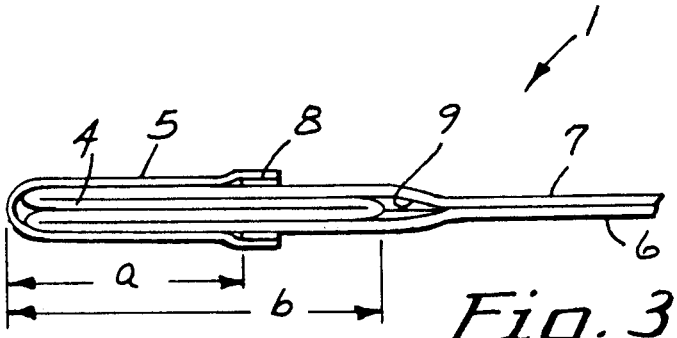
FIG. 3 is a top view of the elastic as attached to the gussetted bag of FIG. 1.

As seen generally in FIGS. 1 and 3, transversing at least one gusset, is an elastic member 5. The elastic member is attached at its ends 8 to both the front and rear panels 6 and 7. The elastic fold is preferably closely adjacent the edge folds 3. When so placed, the elastic will lie flat allowing ready packaging of the bag. The elastic member is located at or near the top open end of the gussetted bag 1. The elastic can be placed up to the top edge of the bag which, for bags with an uneven top profile, is the highest edge with a bag film continuously along the full circumference of the bag. Preferably, however, the elastic would be placed ⅛ to 6 inches (0.3 to 15.1 cm) from the top edge of most bags, such as trash bags.

Figure 2:
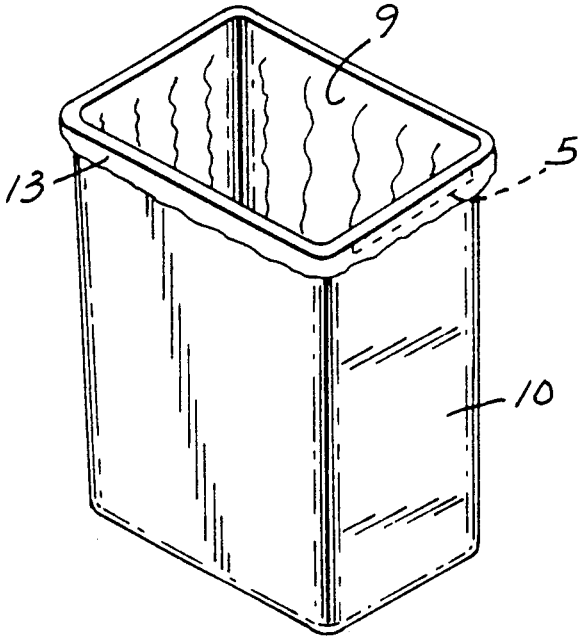
FIG. 2 is a bag in accordance with FIG. 1 as it would be used on a garbage bag.

In use, as shown in FIGS. 1 and 2, the upper edge portion 13 of the bag will be turned over the top of the container at approximately line 12. Included on this turned over portion 13 is the elastic member. When the bag is so placed on the appropriate size container 10, the gussetted side edges will open up exposing the bag interior 9. This will stretch the elastic attached to the front and rear panels 6 and 7. In the embodiment illustrated in FIG. 1, with the elastic fold directly adjacent the edge folds 3, the maximum amount of stretch will equal twice the fold length (2 times b in FIG. 3). The strain imposed by the stretched elastic will retain the edge portion 13 on the lip of the container 10. After the bag is full, it is removed from the container. The edge portion 13 of the bag can then be gathered by the user. The gathered or twisted top portion of the bag can be maintained by an independent closure element such as a twist tie or plastic closure such as per U.S. Pat. No. 4,477,950. However, advantageously, the elastic member 5 can be wrapped around the gathered portion to effect closure of the bag without the need for a separate closure element.

Elastic members can be placed on one or both gusset folds. Placing elastic on two gusset folds will more evenly distribute forces and allow greater flexibility in the fitting of various container sizes. Shorter elastic can also be used, which is more suited for use as a closure after the bag is full. Alternatively, a bag could be made having one side gusset.

Figure 4:
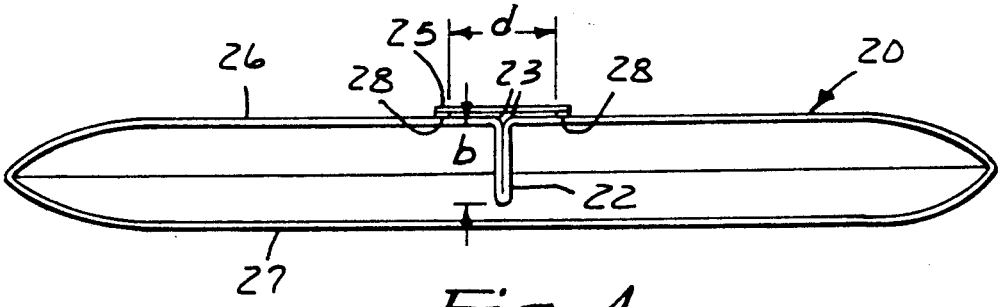
FIG. 4 is a top view of an alternative embodiment of the invention.

An alternative embodiment is shown in FIG. 4 where the gusset 22 is located on a panel 26 and/or 27 of the bag 20. The elastic member 25 is attached at either side of the edge folds 23 of the gusset 22. The area of elastic available for stretching d between the attachment regions 28 can bridge the gusset in either a centered or off-centered manner. However, a centered location is preferred. The amount of material in the fold determines the maximum amount of stretch. In FIG. 4, this is two times b. Although one gusset is depicted in FIG. 4, two or more gussets can be present at any location on either panel.

The gussetted elastic system can also be used in bags as only a closure member or as only an opening member.

The elastic member can be formed of any suitable elastomeric material and, for reasons of economy, is preferably a film or bandlike material. However, other elastic materials such as elastic strand composites or non-woven elastics are also suitable. Exemplary elastic materials include natural rubber, urethane elastomers, polyether esters, EVA, ethylene propylene copolymer rubber, block copolymer rubbers, butyl rubber, polyisobutadiene and mixtures of these copolymers. When used as an opening member, the elastic material should be formed so that it exhibits a tensile force of generally from 1 to 50 g/mm when the gusset is unfolded and the elastic is fully extended. For example, a force less than 1 g/mm may not be sufficient to keep the bag attached to the container. A force greater than 50 g/mm may cause a common garbage bag to tear. However, to some extent, this can be mitigated by making the elastic member wider, at least at its attachment end 8, to distribute the force, or by using bags with greater tear strength. Common garbage bags are formed of polyethylene film generally about 0.0015 inches thick (kitchen bag). Thicker or reinforced (e.g., multilayer) bags can withstand greater inside forces at the point of attachment of the elastic to the bag. For example, large drum liners may withstand forces up to 3 times or more that of conventional trash bags. The elastic can be attached to the plastic bag by any suitable method such as by heat sealing, sonic welding, adhesives or the like. If heat or sonic welding are used, the bag film underlying the film being attached to the elastic must be protected to prevent bonding of the bag to itself. This can be done, for example, with heat shields or precision-controlled welding, (e.g., the elastic material and bag film can be selected to have disparate melting points and the welding controlled only to melt the elastic material).

A preferred elastic material is that described in copending U.S. application No. 438,593, filed 11/17/89. This material is a composite elastomeric laminate having at least one elastomeric layer and at least one skin layer. When cast, or after formation, the elastomeric laminate is substantially inelastic. Elasticity can be imparted to the inelastic laminate by stretching the laminate, by at least a minimum activation stretch or draw ratio, wherein an elastomeric material will form immediately, over time or upon the application of heat. The method by which the elastomeric material is formed can be controlled by a variety of means. After the laminate has been converted to an elastomer, there is formed a novel texture in the skin layer(s) that provides significant advantages to the elastomeric laminate.

The elastomeric composite is non-tacky both before and after it has the microtextured surface. This facilitates handling during manufacturing and minimizes the possibility of bags blocking when folded and packaged, e.g., as a roll. The material also has a reduced tendency to neck when stretched and degrade prior to use. Recovery can also be slightly delayed so that the elastic does not snap back immediately when placed on the trash container.

The elastomer used can broadly include any material which is capable of being formed into thin films and exhibits elastomeric properties at ambient conditions. Elastomeric means that the material will substantially resume its original shape after being stretched. Further preferably, the elastomer will sustain only small permanent set following deformation and relaxation which set is preferably less than 20 percent and more preferably less than 10 percent of the original length at moderate elongation, e.g., about 400–500%. Generally, any elastomer is acceptable which is capable of being stretched to a degree that will cause permanent deformation in the relatively inelastic skin layer. This can be as low as 50% elongation. Preferably, however, the elastomer is capable of undergoing up to 300 to 1200% elongation at room temperature, and most preferably up to 600 to 800% elongation at room temperature. The elastomer can be both pure elastomers and blends with an elastomeric phase or content that will still exhibit substantial elastomeric properties at room temperature.

The skin layers can be formed of any semi-crystalline or amorphous polymer that is less elastic than the core(s) and will undergo permanent deformation at the stretch percentage that the elastomeric core(s) will undergo. Therefore, slightly elastic compounds, such as some olefinic elastomers, e.g., ethylene-propylene elastomers or ethylene-propylene-diene terpolymer elastomers or ethylenic copolymers, e.g., ethylene vinyl acetate, can be used as skin materials, either alone or in blends. However, the skin is generally a polyolefin such as polyethylene, polypropylene, polybutylene or a polyethylene-polypropylene copolymer, but may also be wholly or partly polyamide such as nylon, polyester such as polyethylene terephthalate, polyvinylidene fluoride, polyacrylate such as poly(methyl methacrylate) (only in blends) and the like, and blends thereof. The skin material can be influenced by the type of elastomer selected. If the elastomeric core is in direct contact with the skin, the skin should have sufficient adhesion to the elastomeric core(s) such that it will not readily delaminate. Where a high modulus elastomeric core(s) is used with a softer polymer skin, a microtextured surface may not form.

Other layers may be added between the core(s) and the skin such as tie layers to improve bonding, if needed. Tie layers can be formed of, or compounded with, typical compounds for this use including maleic anhydride modified elastomers, ethyl vinyl acetates and olefins, polyacrylic amides, butyl acrylates, peroxides such as peroxypolymers, e.g., peroxyolefins, silanes, e.g., epoxysilanes, reactive polystyrenes, chlorinated polyethylene, acrylic acid modified polyolefins and ethylvinyl groups and the like, which can also be used in blends or as compatibilizers in one or more of the matrix or core(s). Tie layers are sometimes useful when the bonding force between the matrix and core is low, although the intimate contact between skin and core should counteract any tendency to delaminate. This is often the case with a polyethylene skin as its low surface tension resists adhesion.

Additives to the core discussed above can significantly affect the shrink recovery mechanism. For example, stiffening aids such as polystyrene can shift an otherwise heat shrinkable material into a time or instant shrink material. However, the addition of polypropylene or linear low density polyethylene (less than 15%) to a styrene/isoprene/styrene block copolymer core resulted in exactly the opposite effect, namely transforming time or instant shrink materials to heat shrink or no shrink materials. However, the possibility of polyolefin use in the elastomeric core is significant from a processing standpoint in permitting limited recycling of off batches. Also, polyolefin additives can lower extruder torque.

The overall structure of the film material may be formed by any convenient process such as by pressing materials together, coextruding or the like, but coextrusion is the preferred process for forming the material. The core and matrix are typically coextruded through a specialized die and feedblock that will bring the diverse materials into contact while forming the film material.

The die and feedblock used are typically heated to facilitate polymer flow and layer adhesion. The temperature of the die depends upon the polymers employed and the subsequent treatment steps, if any. Generally, the temperature of the die is not critical, but temperatures are generally in the range of 350 to 550° F. (176.7 to 287.8° C.) with the polymers exemplified.

After formation, the film material is stretched past the elastic limit of the skin layer(s) which deforms. The stretched elastomeric core then recovers instantaneously, with time or by the application of heat. For heat activated recovery, the inherent temperature of heat activation is determined by the composition used to form the elastic core(s) of the composite film material in the first instance. However, for any particular composite film the core material activation temperature can be adjusted by varying the matrix skin/core ratios, adjusting the percent stretch or the overall film thickness.

The counter-balancing of the elastic modulus of the elastomeric core and the deformation resistance of the matrix skin layer(s) also modifies the stress-strain characteristics of the activated regions of the film material. For example, a relatively constant stress-strain curve can be achieved. This relatively constant stress-strain curve can also be designed to exhibit a sharp increase in modulus at a predetermined stretch percent.

When used, the composite material is initially inelastic. It is then stretched, and at an activation point, the elastic recovery forces of the core will overcome the restraining forces of the skin layers. At this point, the composite can be released and will be elastic. The amount of stretch required to activate the composite into its elastic state will depend on the materials employed, the relative thicknesses of the core and/or skin layers and the presence of any modifying agents.

When present on the gussetted bag, the amount of stretch imparted by placing the bag on a container can be expressed by the following equation:

$$D_R = F_L/d + 1$$

where $D_R$ is the draw ratio, $F_L$ is the length of the gusset fold (2 times b in FIGS. 3 and 4) and d is the length of the elastic from attachment zone to attachment zone (the total amount of elastic available for stretch, 2 times a in FIG. 3). Thus, the draw ratio (stretch) for a particular elastic member can be increased by increasing the gusset fold length or decreasing the elastic length d.

The minimum draw ratio required to activate the elastic will vary as discussed above. However, a draw ratio from 2.5:1 to 7:1 will generally be sufficient for most constructions. With a given minimum draw ratio requirement for a material and gusset fold material length, a suitable elastic length (d plus attachment regions) can be determined using the above equation. Preferably, the elastic length d should be selected so that the draw ratio will be above the minimum required by at least 10%, and preferably 20%.

The following examples are provided to illustrate presently contemplated preferred embodiments and the best mode for practicing the invention, but are not intended to be limiting thereof.

EXAMPLE 1

An elastic composite was formed by extruding a core and two skin layers through a CLOEREN TM (Cloeren Co., Orange, Tex.) 3-layer feedblock and an 18 inch (45.7 cm) film die. The core comprised 89% styrene-isoprene-styrene (KRATON TM D-1107, Shell Chemical Co., Beaupre, Ohio), and 10% poly(alpha-methyl)styrene (AMOCO TM 18-210, Amoco Oil Co., Chicago, Ill.) and 1% IRGANOX TM 1076 (Ciba-Geigy Corp., Hawthorne, N.Y.). The skin material comprised polypropylene (ESCORENE TM 3085, Exxon Corp., Houston, Tex). The ratio of a skin layer to the core was approximately 6.6:1 for a 5.0 mil (0.12 mm) film. The film was then cut and attached to gussetted polyethylene with a transfer adhesive tape (3M 443 SCOTCH TM double-coated SBS synthetic rubber based adhesive tape). The dimensions of the bags and the elastic strips are given in Table I below.

TABLE I

| Gusset Depth (in cm) | $F_L$ (in cm) | $D_R$ | d (in cm) | Tab Width (in cm) | Adhesive Length (in cm) | Total Tab Length (in cm) |
|---|---|---|---|---|---|---|
| 8.9 | 17.8 | 5.5 | 3.9 | 2.5 | 2.5 | 9.0 |
| 6.4 | 12.7 | 5.5 | 2.8 | 2.5 | 1.3 | 5.3 |
| 5.1 | 10.2 | 5.5 | 2.2 | 2.5 | 1.3 | 4.8 |

The bags were GLAD TM large kitchen trash bags folded to provide the above indicated gusset lengths. When used in a standard-size kitchen bag (a RUBBER- MAID TM 30-quart trash can, No. 2846), all the above samples functioned adequately.

The various modifications and alterations of this invention will be apparent to those skilled in the art without departing from the scope and spirit of this invention, and this invention should not be restricted to that set forth herein for illustrative purposes.

We claim:

1. A gussetted bag or the like comprising:

two panels forming a closed bottom and open top wherein the panels are joined along at least one side edge via a gusset edge fold, each panel having a face, each gussetted side edge comprising two leading edge folds along a longitudinal edge region at least adjacent a top edge of each of said panels and at least one inner fold region, and at least one elastic member having at least two opposing ends wherein one of said ends is attached at an attachment region to the face of one of said panels, and the other of said ends is attached at an attachment region to the face of the other said panel, said attachment regions being placed adjacent a leading edge fold and the top edge so that the elastic is folded over the gusset fold.

2. The gussetted bag of claim 1 wherein the fold line of the elastic is closely adjacent the outermost leading edge fold line and wherein the longitudinal edge region comprising said edge folds extends along the full side edge where said two panels are joined.

3. The gussetted bag of claim 1 wherein the elastic exerts a tensile force of between 1 and 50 g/mm.

4. The gussetted bag of claim 1 wherein there is a gusset fold along each side of the bag.

5. The gussetted bag of claim 4 further comprising at least a second gussetted fold having an elastic member attached at either side of the gusset fold at attachment regions at the respective ends of the elastic member.

6. The gussetted bag of claim 1 wherein the elastic material comprises an inelastic composite film of an elastomeric core layer and at least one inelastic skin layer wherein the material is capable of becoming elastic after being stretched by a minimum activation draw ratio.

7. The gussetted bag of claim 6 wherein an elastic member maximum length is determined by the following equation:

$$d = \frac{F_L}{D_R - 1}$$

where $F_L$ is the length of the gusset fold and $D_R$ is the minimum draw ratio required to activate film to the elastic state and d is the length of the elastic member between the elastic member attachment regions.

8. The gussetted bag of claim 7 wherein $D_R$ is at least 10% above the minimum activation draw ration.

9. The gussetted bag of claim 1 wherein the elastic member is located ⅛ to 6 inches (0.3 to 15.1 cm) from the top edge of the bag.

10. The gussetted bag of claim 1 comprising a trash bag.

11. A gussetted bag comprising:

two panels forming a closed bottom and an open top, at least one gusset fold comprising two leading edge folds, at least one inner fold region on at least one panel said gusset fold extending at least partially between said closed bottom and said open top, and at least one elastic member having at least two opposing ends wherein one of said ends is attached at an attachment region to said panel on one side of said gusset fold, and a second of said ends is attached at an attachment region to said panel at an opposing side of said gusset fold.

12. The gussetted bag of claim 11 wherein the elastic exerts a tensile force of between 1 and 50 g/mm.

13. The gussetted bag of claim 11 wherein the elastic material comprises an inelastic composite film of an elastomeric core layer and at least one inelastic skin layer wherein the material is capable of becoming elastic after being stretched by a minimum activation draw ratio.

14. The gussetted bag of claim 13 wherein an elastic member maximum length is determined by the following equation:

$$d = \frac{F_L}{D_R - 1}$$

where $F_L$ is the length of the gusset fold and $D_R$ is the minimum draw ratio required to activate film to the elastic state and d is the length of the elastic member between the elastic member attachment regions.

15. The gussetted bag of claim 14 wherein $D_R$ is at least 10% above the minimum activation draw ration.

16. The gussetted bag of claim 11 wherein the elastic member is located ⅛ to 6 inches (0.3 to 15.1 cm) from the top edge of the bag.

* * * * *